United States Patent [19]

Baldwin

[11] Patent Number: 4,781,100

[45] Date of Patent: Nov. 1, 1988

[54] LINKLESS AMMUNITION GUN TRANSFER UNIT

[75] Inventor: William C. Baldwin, Irvine, Calif.

[73] Assignee: Western Design Corporation, Irvine, Calif.

[21] Appl. No.: 59,538

[22] Filed: Jun. 8, 1987

[51] Int. Cl.[4] ..... F41D 10/04; F41D 10/32

[52] U.S. Cl. ..... 89/33.04; 89/33.25; 89/128

[58] Field of Search ..... 89/33.01, 33.04, 33.16, 89/33.17, 33.25, 128

[56] References Cited

U.S. PATENT DOCUMENTS

| | | | |
|---|---|---|---|
| 2,800,056 | 7/1947 | Atherton | 89/33.16 |
| 3,370,506 | 2/1968 | Altschuler et al. | 89/33.16 |
| 3,875,845 | 4/1975 | Hupp et al. | 89/33.04 |
| 4,434,699 | 3/1984 | Tassie | 89/33.04 |
| 4,457,208 | 7/1984 | Golden | 89/33.04 |

*Primary Examiner*—Stephen C. Bentley
*Attorney, Agent, or Firm*—Walter A. Hackler

[57] ABSTRACT

A Linkless-Ammunition Gun Transfer Unit is provided for the conversion of a linked-ammunition firing gun to a linkless-ammunition firing gun, which includes a drive train for engaging ammunition feed sprockets disposed in the existing ammunition feeder and coupling means for removably attaching a linkless-ammunition feed chute to the ammunition feeder assembly and aligning the ammunition feed sprockets in the ammunition feeder assembly with the ammunition transfer sprockets disposed in the feed chute. Power from the gun is utilized to operate the linkless-ammunition feed mechanism.

12 Claims, 4 Drawing Sheets

4
4
256
58
214
232
46
164
150
238
72
186
208
202
196
162
232
48
114
36
234
224
150
80
92
32
30
102
96
30
32
98
26
94
60
216
50
204
168
74
188
104
152
198
166
152
210
276
52
116

LINKLESS AMMUNITION GUN TRANSFER UNIT

The present invention is generally related to ammunition feeding systems for automatic weapons and, more particularly, directed to apparatus for the conversion of a linked-ammunition firing gun to a linkless-ammunition firing gun.

Many weapon systems utilize linked ammunition. Linked ammunition refers to ammunition which is held together by coupling devices (links) which enables the ammunition to be pulled into the gun's receiver as it is fired.

A typical linked ammunition firing gun in the U.S. arsenal is the M242 25 mm Bushmaster chain gun. The gun may be turret mounted in an infantry fighting vehicle and has a dual feed apparatus for alternatively feeding high explosive (HE) or armor piercing (AP) rounds into the gun for firing. In this operation two bands of ammunition, HE and AP, must be simultaneously provided to the feeder apparatus during operation of the gun.

The use of linked ammunition for an infantry fighting vehicle has a number of disadvantages. First, the ammunition is vulnerable to damage and/or detonation by flying debris. Second, when the gun feeder assembly is opened to clear it, the linked ammunition must be disconnected in order to gain full access to the feeder assembly.

In addition, the loading of ammunition requires the turret to be opened in order to pass boxed ammunition thereinto. It is well known that linked-ammunition requires considerably more storage space than unlinked, or linkless ammunition. Hence, an obvious advantage of using linkless ammunition is the weight and bulk savings by the elimination of the ammunition links.

Many modern guns have been designed to handle and fire linkless ammunition. There are a number of guns, such as the M-242 chain gun, which would be better suited for use in confined areas, such as an infantry fighting vehicle, if it could be adapted, or converted, to the use of linkless ammunition.

The present invention fills that need in providing apparatus for converting a linked-ammunition firing gun into a gun system capable of handling and firing linkless ammunition. Independent feeding of both HE and AP ammunition into the existing M242 gun feeder assembly is provided at rates up to 500 shots per minute (SPM). In addition, the present conversion apparatus can be installed in an existing gun without significant alteration to the existing gun feeder assembly. Maintainability of the gun is greatly enhanced because of the quick disconnect features of the present invention which enables access to the gun feeder assembly and receiver without the necessity of unlinking ammunition in the gun feeder assembly as was heretofore necessary with linked ammunition.

SUMMARY OF THE INVENTION

A linkless-ammunition gun transfer unit in accordance with the present invention for the conversion of a linked-ammunition firing gun to a linkless-ammunition firing gun generally includes a drive train means for engaging ammunition feed sprockets disposed in the existing ammunition feeder assembly and plate means, configured for attachment to the ammunition feeder assembly, for supporting the drive train means.

Coupling means are provided for removably attaching a linkless ammunition feed chute to the ammunition feeder assembly and aligning the ammunition feed sprockets in the ammunition feeder assembly with ammunition transfer sprockets disposed in the feed chute to enable the transfer of linkless ammunition therebetween. More particularly, the linkless ammunition transfer unit coupling means engages the drive means when the feed chute is attached to the ammunition feeder assembly for transferring power from the ammunition feed sprockets to the transfer sprockets in order to move the ammunition through the ammunition feed chute. In this manner, power from the gun, which may be chain-driven, is utilized to operate the linkless ammunition feed mechanism; hence, no auxiliary equipment is necessary for providing power to feed the linkless ammunition.

For providing two different kinds of ammunition, such as high explosive and armor piercing, to the gun, coupling means may be provided for removably attaching two linkless ammunition feed chutes to the feeder assembly and aligning the ammunition feed sprockets in the ammunition feeder assembly with ammunition transfer sprockets disposed in each of the two linkless ammunition feed chutes to enable transfer of linkless ammunition from either of the two linkless ammunition feed chutes into the ammunition feeder assembly.

In order to facilitate in-field servicing of the gun, the linkless ammunition gun transfer unit includes coupling means which comprise a transversely movable shaft configured for passing through the ammunition transfer sprockets disposed in the feed chute and engaging the drive means. Spline means disposed on the transversely movable shaft are configured for engaging a key way disposed in the ammunition transfer sprockets to align the sprockets with the ammunition feed sprockets to enable transfer of linkless ammunition rounds therebetween.

A manually removable quick disconnect or pin means is provided for engaging the transversely movable shaft to prevent unwanted movement thereof. Upon removal of the pin means, the shaft may be manually removed and the feed chutes separated from the feeder assembly, thus enabling clear access thereto.

Hence, when access to the feeder assembly is required for service or inspection thereof, the manual removal of two pins enables the complete disassembly of the feed chutes from the feeder assembly. As hereinbefore pointed out, the spline means disposed on the transversely movable shaft causes the insertion of the shaft to align the feed chute ammunition feed sprockets with the feed sprocket and the feed assembly.

Minimal alteration of the linked-ammunition firing gun or its ammunition feeder assembly is necessary according to the present invention. Clevis blocks are provided for attachment to mechanical fittings already existing and configured for supporting linked strippers originally provided with the linked ammunition firing gun. The link strippers are removed and the clevis blocks inserted into the fittings without modification of the ammunition feeder assembly. The transversely movable shaft is configured for passing through the clevis block, thereby securely and removably attaching the feed chute to the feeder assembly.

The drive train means includes a gear train, which is configured smaller than the profile of the plate means and the plate has dimensions enabling the plate means to be mounted to the existing feeder assembly without significant protrusion therefrom. In this manner the overall profile of the plate means and feeder assembly is substantially the same as it would be if it were firing linked ammunition. This is important in that adequate clearance must be provided for operation of the weapon, particularly turret mounted guns.

BRIEF DESCRIPTION OF THE DRAWINGS

The advantages and features of the present invention will appear from the following description when considered in conjunction with the accompanying drawings, in which.

DETAILED DESCRIPTION

Figure 1:
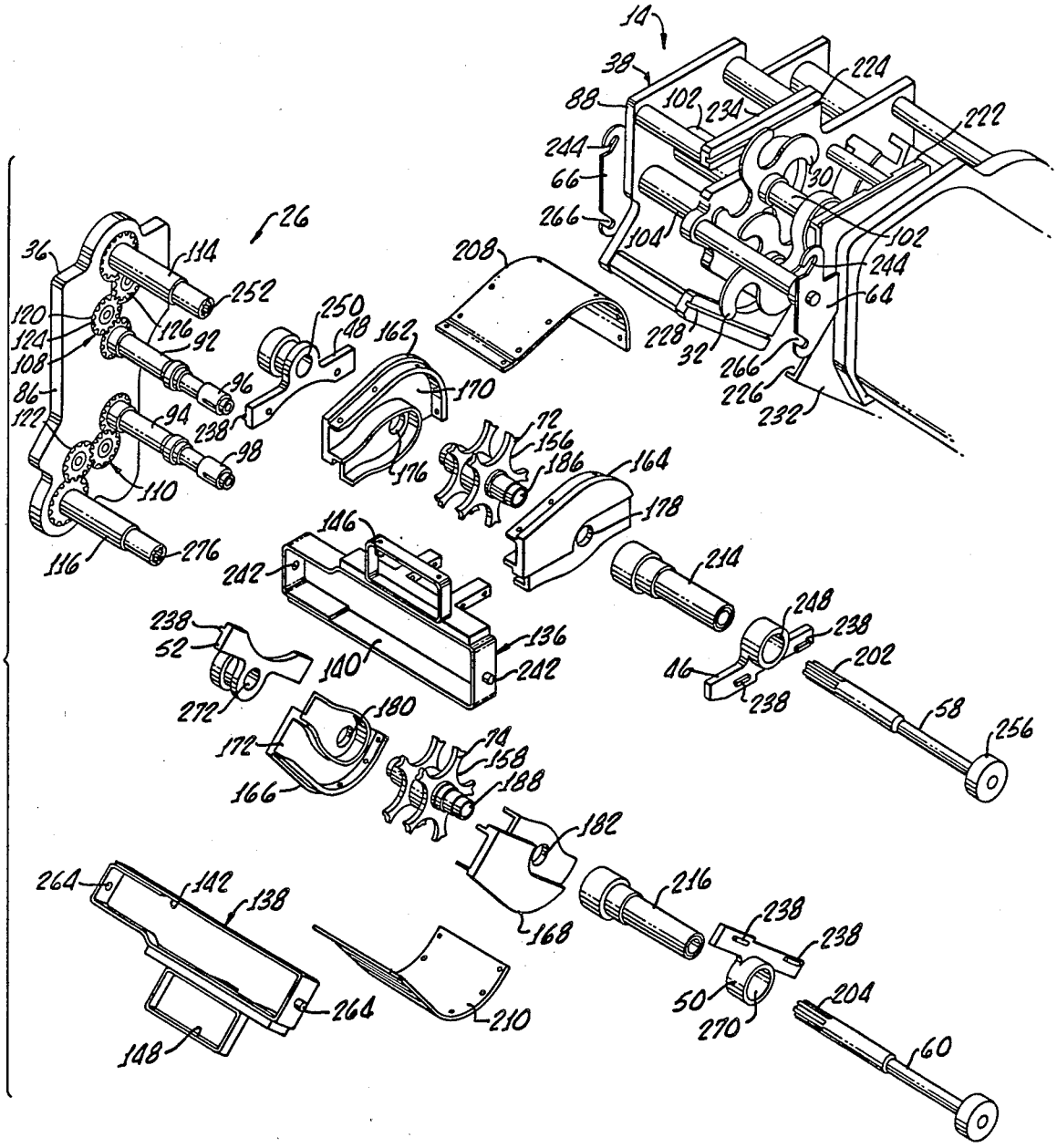
FIG. 1 is an exploded perspective view of the linkless-ammunition gun or transfer unit in accordance with the present invention.
Figure 2:
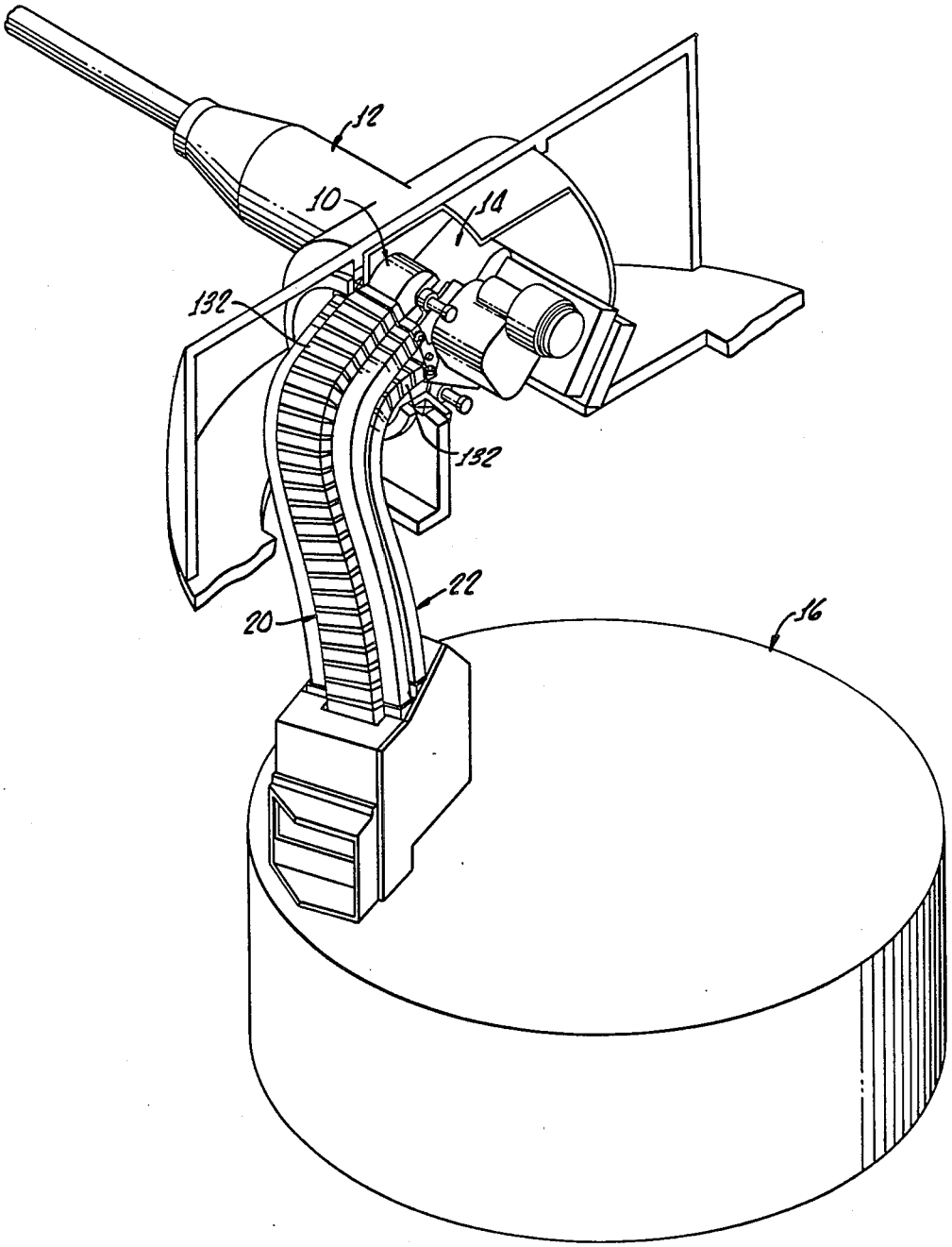
FIG. 2 is a perspective view of a linkless ammunition gun-transfer unit in accordance with the present invention as it may be installed on an M-242 25 mm chain gun which may be turret-mounted.

Turning now to FIGS. 1 and 2, there is shown a linkless-ammunition gun transfer unit 10 in accordance with the present invention for converting a linked ammunition firing gun 12, such as a U.S. M-242 chain gun having an existing feeder assembly 14, so that the gun 12 can fire unlinked, or linkless, ammunition. The M-242 gun illustrated as it may be mounted on a turret 16 disposed on infantry fighting vehicle (not shown).

The gun-transfer unit 10 is mounted to the feeder assembly 14 without significant modification thereto and provides for the releasable attachment of feed chutes 20, 22, to enable in-field separation thereof for maintenance and service of the feeder assembly 14, as will be hereinafter described in greater detail.

Turning specifically to FIG. 1, the linkless-ammunition gun-transfer unit 10 generally includes a drive train 26 which provides means for engaging ammunition feed sprockets 30, 32 disposed in the ammunition feeder assembly 14, a plate 36 which is configured for attachment to a front housing 38 in any suitable manner which provides means for supporting the drive train 26 as will be hereinafter described in greater detail.

Figure 3:
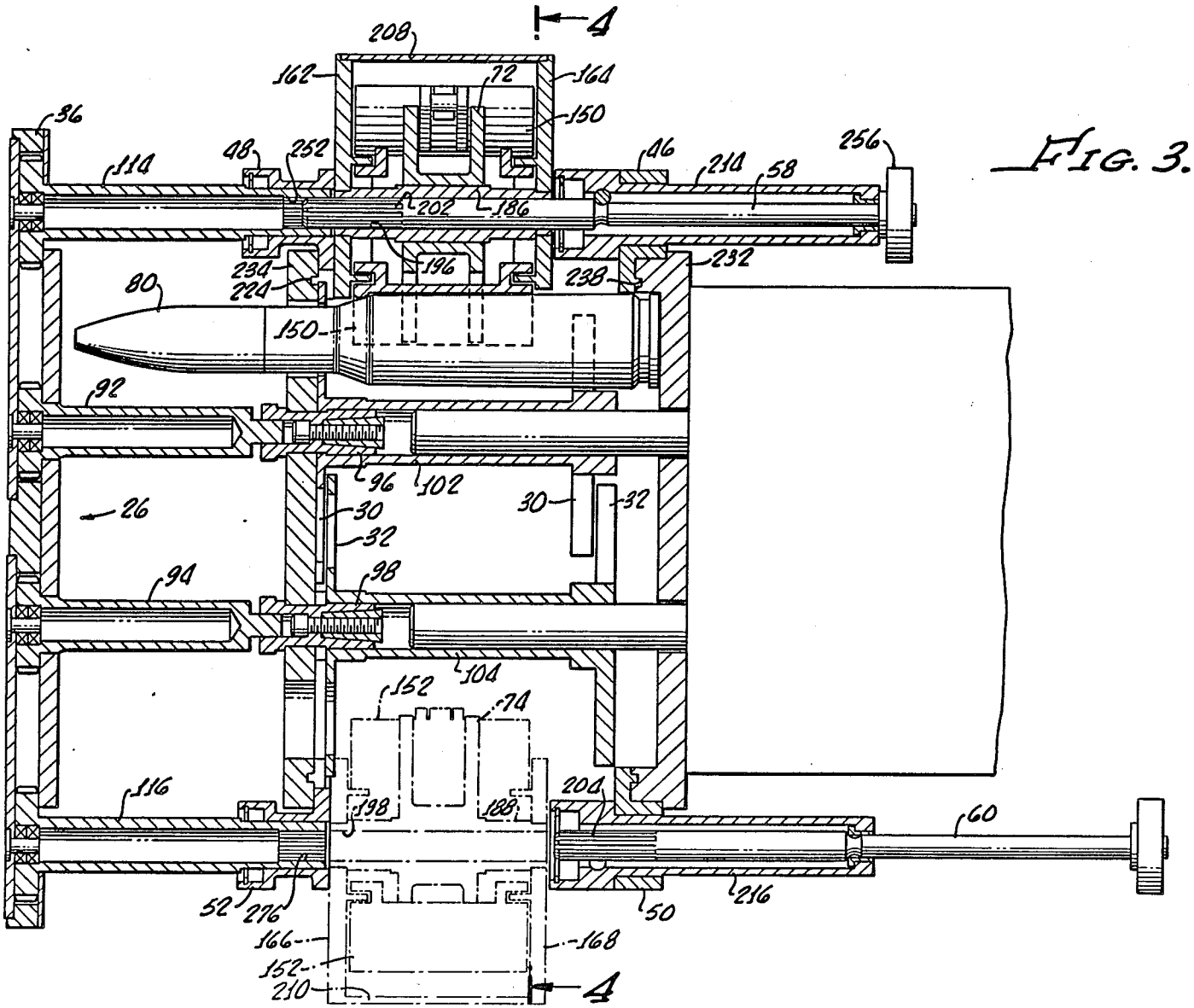
FIG. 3 is a cross-sectional view of the linkless-ammunition gun transfer unit in accordance with the present invention, taken along the line 3—3 of FIG. 4.
Figure 4:
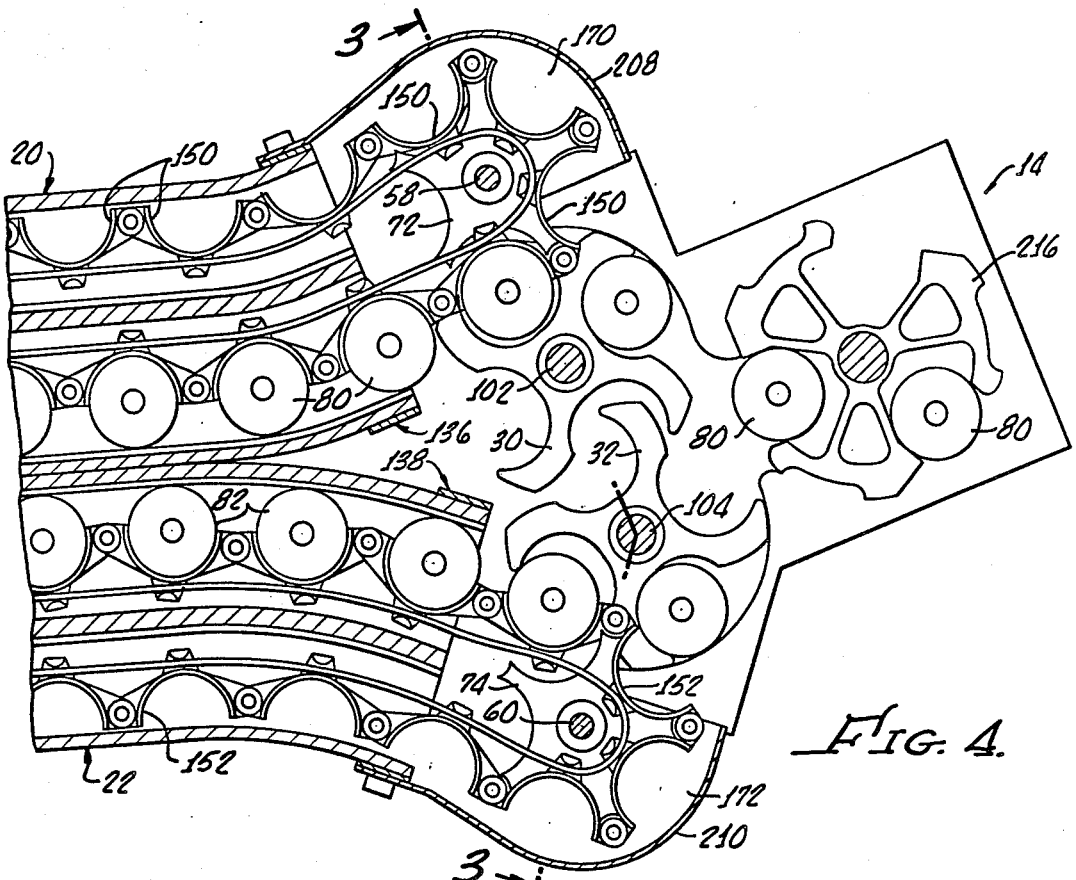
FIG. 4 is a cross-sectional end view of the linkless-ammunition-transfer unit in accordance with the present invention.
Figure 5:
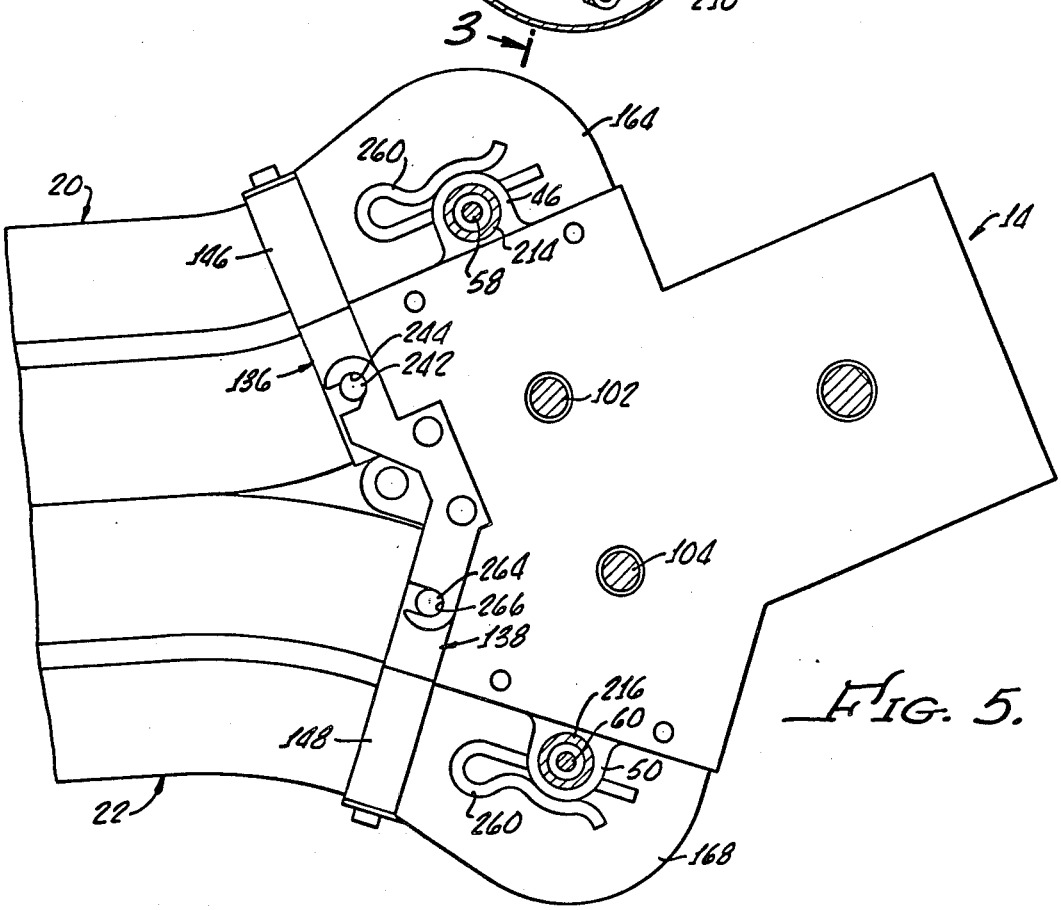
FIG. 5 is a end view of the linkless-ammunition-transfer unit in accordance with the present invention.

Also provided in the present invention are clevis blocks 46, 48, 50, 52, shafts 58, 60 and brackets 64, 66, which in combination provide coupling means for removably attaching the ammunition feed chutes 20, 22 (FIG. 1) to the ammunition feeder assembly 14 and aligning the ammunition feed sprockets 30, 32 in the ammunition feed assembly 14 with ammunition transfer sprockets 72, 74 disposed in the ammunition feed chutes 20, 22, respectively, to enable the transfer of linkless ammunition rounds 80, 82 therebetween, see FIGS. 3 and 4.

More particularly, the plate 36 which supports the drive train 26 is configured with an outside contour 86 which generally conforms to the exterior shape 88 of the front housing 38 to enable the plate 36 to be mounted to the ammunition feeder assembly 14 without significant protrusion therefrom. The drive train 26 includes two power takeoff spindles 92, 94 with ends 96, 98 thereon, respectively, for engaging shafts 102, 104, respectively, through the front housing 38, said shafts 102, 104 being coupled, respectively, to ammunition feed sprockets 30, 32, which are power driven by the feeder assembly 14. It should be appreciated that the shaft ends 96, 98 may be configured in any suitable fashion to engage shafts 102, 104 and may vary depending upon the feeder assembly to which the transfer unit 10 is to be attached. The feeder assembly 14 is not part of the present invention.

Power taken from the shafts 102, 104 by the takeoff shafts 92, 94 is transmitted through gear trains 108, 110 to transfer sprocket drive shafts 114, 116 for driving the transfer sprocket 72, 74 as hereinafter described in order to move ammunition through the feed chutes 20, 22.

In order to conserve space, the gear trains 108, 110 are disposed in cutouts 120, 122 and a multiple number of idler gears 124, 126 are provided between the power takeoff shaft 92 and the drive shaft 14 in order to enable the overall shape of the plate 36 to not exceed the overall dimensions of the front housing 38. The drive trains 108, 110 are configured for enabling appropriate rotational speeds of the drive shafts 114, 116 and transfer sprockets 72, 74 coupled, thereto to enable transfer of linkless-ammunition 80, 82 between the transfer sprockets 72, 74 and the ammunition feed sprockets 30, 32 when the feed chutes 20, 22 are coupled to the magazine housing 14.

Each of the feed chutes 20, 22 are formed from a plurality of elements 132 (see FIG. 2). FIG. 1 shows end elements 136, 138 of the feed chutes 20, 22, respectively, and are not part of the present invention. The feed chutes 20, 22 are flexible and coupled to one another in a conventional manner and each provide an opening 140, 142, respectively, for the movement of ammunition 80, 82 therethrough, and a smaller opening 146, 148, respectively, for conveyor elements 150, 152 (FIGS. 3 & 4) which are interconnected with one another in a conventional manner. The conveyor elements,150, 152 engage and are driven by arcuate portions 156, 158 of the transfer sprockets 72, 74 in a conventional manner.

Attached to the end elements 136, 138 are side pieces 162, 164, 166, 168, respectively, which provide channels 170, 172 for the ammunition rounds 80, 82 and conveyor elements 150, 152, respectively, as they travel around the transfer sprockets 72, 74, respectively. Shaft holes 176, 178, 180, 182 provide for rotational mounting of the transfer sprockets 72, 74 therebetween on shafts 186, 188, respectively. As will be described hereinafter in greater detail, each shaft 186, 188 is hollow and has a internal spline or keyway 196, 198, respectively, (FIG. 3) for engaging a spline 202, 204 on shafts 58, 60, respectively, for enabling alignment of the transfer sprocket 72, 74, with the ammunition feed sprockets 30, 32, when the feed chutes 20, 22 are coupled to the feeder assembly 14.

The side pieces 162, 164 are fixed in a spaced-apart relationship with one another by attachment to both the end element 136 and a cover 208 in a conventional manner. Similarly, the side pieces 166, 168 are attached to the end element 138 and a cover 210. Hollow spacer shafts 214, 216 are disposed against the side pieces 164, 168, respectively, in any conventional manner in order to align the transfer sprockets 72, 74 with the ammunition feed sprockets 30, 32 when the feed chutes 20, 22 are coupled to the feeder assembly 14.

The feed chutes 20, 22 may be rapidly coupled and uncoupled to the feeder assembly 14 in the field to enable servicing or maintenance thereof. It should be appreciated from FIG. 1 that when the feed chutes 20, 22 are uncoupled from the feeder assembly 14, the feed sprockets 30, 32 are readily accessible, thereby enabling removal of ammunition therefrom to gain access to chamber portions of the gun, not shown, or to remove jammed ammunition rounds from the feeder assembly 14.

As hereinabove mentioned, the feeder assembly 14 is not a part of the present invention, however, it is adapted to the handling of linkless ammunition magazine by the gun transfer unit of the present invention. FIGS. 2–5 show the feed chutes 20, 22 coupled to the feeder assembly 14 by the gun transfer unit 10 of the present invention and generally showing the feed chutes 20, 22 passing ammunition rounds 80, 82 into the feed sprockets 30, 32, respectively. The feed sprockets 30, 32 pass the ammunition rounds to a chamber sprocket 216, (FIG. 4) which positions the ammunition rounds for firing by the gun 12.

It should be appreciated that the workings of the feeder assembly are conventional and that ammunition 80, 82 is alternatively fed through either of the feed chutes 20, 22 during operation of the gun.

Importantly, the present invention provides for the rapidly coupling and uncoupling of the feed chutes 20, 22 to the feeder assembly 14, while at the same time necessarily aligning the transfer sprockets 72, 74 with the ammunition feed sprockets 30, 32 in order to harmoniously pass ammunition therebetween.

This is accomplished through the clevis blocks 46, 48, 50, 52, pins 58, 60 and brackets 64, 66.

The ammunition feeder assembly 14 is generally provided with link strippers, not shown, which are necessary to strip ammunition rounds from their interconnection links as the ammunition is taken up by the ammunition feed sprockets 30, 32. These links are disposed in slots 222, 224, 226, 228 formed in members 232, 234. These slots are utilized in the present invention to mount the clevis blocks 46, 48, 50, 52, respectively, by way of lugs 238 thereon. Hence, no modification of the feeder assembly is necessary for attachment of the clevis blocks 46, 48, 50, 52 thereto. The clevis blocks are permanently mounted to the ammunition assembly 14 and the feed chute 22 is coupled to the assembly 14 by placing a pin 242 on the end element 136 in notches 244 in the bracket 64, 66, respectively, and then passing the shaft 58 through clevis block hole 248, the shaft 214, hole 178, shaft 186, hole 176, and a hole 250 in the clevis block 48.

As hereinbefore mentioned, a splined portion 202 engages a mating spline keyway in the sprocket shaft 186 and also into a mating spline keyway 252 in the drive shaft 114. Because the drive shaft 114 is in permanent alignment with the shaft 102 and feed sprocket 30, the keyed relationship between the drive shaft 114 and transfer sprocket 72 allows automatic alignment of the transfer sprocket 72 and feed sprocket 30 when the shaft 58 is fully inserted by translational movement into the keyway 252. Removal of the shaft 58 by a knob 256 enables manual disengagement of the feed chute 20 from the feeder assembly 14. As most clearly shown in FIG. 5, the shaft 58 is held in position by means of a manually operated cotter-type pin 260 in a conventional manner.

Similarly, the feed chute 22 is coupled and uncoupled from the feeder assembly 14 by inserting pins 264 into notches 266 in the brackets 64, 66, respectively, and inserting the shaft 60 through a hole 270 in the clevis block 50 through the spacer shaft 216, hole 182, shaft 188, hole 180 and a hole 272 in the clevis block 52 to engage a keyway 276 in the drive shaft 116. Alignment of the transfer sprocket 74 with the feed sprocket 32 then occurs as was hereinabove described in connection with the coupling and uncoupling of the feed chute 20 with the feeder assembly 14.

Although there has been described hereinabove a specific linkless-ammunition, gun transfer unit in accordance with the present invention for the purposes of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the invention as defined in the appended claims.

What is claimed is:

1. A linkless ammunition gun transfer unit for the conversion of a linked-ammunition firing gun, having an ammunition feeder assembly, to a linkless-ammunition firing gun, said linkless-ammunition gun transfer unit comprising:

drive train means for engaging ammunition feed sprockets disposed in said ammunition feeder assembly;

plate means, configured for attachment to said ammunition feeder assembly, for supporting said drive train means; and coupling means for removably attaching a linkless-ammunition feed chute to the ammunition feeder assembly and aligning the ammunition feed sprockets in the ammunition feeder assembly with ammunition transfer sprockets disposed in said linkless-ammunition feed chute to enable transfer of linkless-ammunition rounds therebetween, said coupling means engaging the drive train means when the feed chute is attached to the ammunition feeder assembly for transferring power from the ammunition feed sprockets to the transfer sprockets in order to move ammunition through said ammunition feed chute.

2. The linkless ammunition gun transfer unit according to claim 1 wherein the coupling means further comprises a transversely moveable shaft configured for passing through the ammunition transfer sprockets disposed in said feed chute.

3. The linkless-ammunition gun transfer unit according to claim 2 wherein the coupling means further comprises spline means, disposed on said transversely moveable shaft, configured for engaging a spline disposed in the ammunition transfer sprockets in said ammunition feed chute.

4. The linkless ammunition gun transfer unit according to claim 3 wherein the coupling means further comprises a manually removable quick disconnect pin means for engaging said transversely moveable shaft to selectively prevent transverse movement thereof.

5. The apparatus according to claim 4 wherein the coupling means further comprises clevis block means for engaging said transversely moveable shaft, sad clevis block means being configured for attachment to mechanical fittings for supporting link strippers on said ammunition feed assembly, and said transversely moveable shaft being configured for passing through the clevis block means.

6. The apparatus according to claim 5 wherein the drive train means comprises a gear train configured with a profile smaller than the profile of the plate means and the plate means has dimensions enabling the plate means to be mounted to the existing ammunition feeder assembly without significant protrusion therefrom.

7. A linkless-ammunition gun transfer unit for the conversion of a linked-ammunition firing gun, having an ammunition feeder assembly, to a linkless-ammunition firing gun, said linkless ammunition gun transfer unit comprising;

drive train means for engaging ammunition feed sprockets disposed in said ammunition feeder assembly;

plate means, configured for attachment to said ammunition feeder assembly, for supporting said drive train means; and coupling means for removably attaching two linkless ammunition feed chutes to the ammunition feeder assembly and aligning the ammunition feed sprockets in the ammunition feeder assembly with ammunition transfer sprockets disposed in each of said two linkless ammunition freed chutes to enable transfer of linkless ammunition from either of the two linkless ammunition feed chutes into said ammunition feeder assembly, said coupling means engaging the drive train means when the feed chutes are attached to the ammunition feed sprockets to the transfer sprockets in each of the two linkless ammunition feed chutes in order to move ammunition through said ammunition feed chutes.

8. The linkless-ammunition gun transfer unit according to claim 8 wherein the coupling means further comprises two transversely moveable shafts, each shaft being configured for passing through the ammunition transfer sprockets disposed in one of said feed chutes.

9. The linkless-ammunition gun transfer unit according to claim 8 wherein the coupling means further comprises spline means, disposed on each of said transversely moveable shafts, and configured for engaging a keyway disposed in the ammunition transfer sprockets in each of said ammunition feed chutes.

10. The linkless-ammunition gun transfer unit according to claim 9 wherein the coupling means further comprises manually removable quick disconnect pin means for engaging said transversely moveable shafts to selectively prevent transverse movement thereof.

11. The apparatus according to claim 10 wherein the coupling means further comprises a clevis block means for engaging said transversely moveable shaft, said clevis block means being configured for attachment to mechanical fittings for supporting link strippers on said ammunition feed assembly, and said transversely moveable shaft being configured for passing through the clevis block means.

12. The apparatus according to claim 11 wherein the drive train means comprises a gear train configured with a profile smaller than the profile of the plate means and the plate means has dimensions enabling the plate means to be mounted to the existing ammunition feeder assembly without significant protrusion therefrom.

* * * * *